US006150064A

United States Patent [19]

Egota et al.

[11] Patent Number: 6,150,064

[45] Date of Patent: Nov. 21, 2000

[54] PHOTOCONDUCTOR FOR ELECTROPHOTOGRAPHY AND METHOD FOR MANUFACTURING THE SAME

[75] Inventors: Kazumi Egota; Yoichi Nakamura; Masahide Takano; Hideki Kina; Akira Ootani, all of Nagano, Japan

[73] Assignee: Fuji Electric Co., Ltd., Japan

[21] Appl. No.: 09/061,379

[22] Filed: Apr. 16, 1998

[30] Foreign Application Priority Data

Apr. 21, 1997 [JP] Japan ..... 9-103033

[51] Int. Cl.[7] ..... G03G 5/047

[52] U.S. Cl. ..... 430/59.5; 430/56; 430/78; 430/133

[58] Field of Search ..... 430/78, 58, 59.5, 430/56, 133

[56] References Cited

U.S. PATENT DOCUMENTS

| | | | |
|---|---|---|---|
| 5,114,815 | 5/1992 | Oda et al. | 430/78 |
| 5,225,551 | 7/1993 | Duff et al. | 430/78 |
| 5,330,867 | 7/1994 | Hsiao et al. | 430/78 |
| 5,804,346 | 9/1998 | Ohashi et al. | 430/78 |
| 5,874,570 | 2/1999 | Tamura et al. | 430/78 |

FOREIGN PATENT DOCUMENTS

| | | |
|---|---|---|
| 0405420A1 | 6/1990 | European Pat. Off. . |
| 03054572 | 3/1991 | Japan . |
| 5-313389 | 11/1993 | Japan . |

*Primary Examiner*—Christopher D. Rodee
*Attorney, Agent, or Firm*—Morrison Law Firm

[57] ABSTRACT

A photoconductor for electrophotography includes a photoconductive layer that contains titanyloxyphthalocyanine as a charge generation agent. The concentration of $SO_4^{2-}$ with respect to the concentration of titanyloxyphthalocyanine is adjusted to be less than or equal to 500 ppm. The photoconductor may be of either a monolayer or a laminate construction. In the case of a laminate type photoconductor, the titanyloxyphthalocyanine is incorporated into the charge generation layer.

13 Claims, 2 Drawing Sheets

PHOTOCONDUCTOR FOR ELECTROPHOTOGRAPHY AND METHOD FOR MANUFACTURING THE SAME

BACKGROUND OF THE INVENTION

The present invention relates to a photoconductor for electrophotography (hereinafter referred to as a "photoconductor") for use in electrophotographic apparatuses, such as printers, copying machines and facsimiles. More particularly, the present invention relates to a stable photoconductor having an improved photoconductive layer. The present invention relates also to a method of manufacturing the photoconductor of the present invention.

It is necessary for photoconductors to retain surface charges in the dark, to generate electric charges in response to received light, and to transport the generated electric charges in response to the received light. Photoconductors may be classified into monolayered photoconductors, which have a layer that exhibits all the above described functions, and laminate-type photoconductors, which have a layer for charge generation and another layer for charge transport.

Conventional photoconductors employ the Carlson method for electrophotographic image formation. Image formation by the Carlson method includes the steps of charging the photoconductor in the dark by corona-discharge, forming electrostatic latent images of the original letters and pictures on the charged surface of the photoconductor, developing the electrostatic latent images with toner, and transferring the developed toner images to the carrier paper. The photoconductor is ready to be used again after steps of discharge, removal of residual toner and optical discharge are completed.

Photoconductive materials used in manufacturing conventional photoconductors may include inorganic materials, such as selenium, selenium alloys, zinc oxide, and cadmium sulfide. Photoconductive materials for conventional photoconductors may also include organic photoconductive materials, such as poly-N-vinylcarbazole, 9,10-anthracenediol-polyester, hydrazone, stilbenebutadiene, benzidine, phthalocyanine compounds, and bisazo compounds. The photoconductive materials are often dispersed in a resin binder. Alternatively, the photoconductive materials may be deposited by vacuum deposition or by sublimation.

To obtain a clear image and to facilitate industrial production, it is important for the photoconductor to be of a sufficient sensitivity and to retain surface charges in the dark, i.e. to exhibit a high charge-retention rate. Furthermore, deviations in the charge retention rate must be confined within a narrow range. To improve these electrophotographic properties, the charge generation pigment is often used in an activation-treated form.

Recently, interest in the use of titanyloxyphthalocyanine-containing photoconductive materials has increased, due to their high sensitivity in the long-wavelength region of 700 nm or longer and possibility of favorable application to semiconductor laser-beam printers. The Japanese Unexamined Laid Open Patent Application No. H05-313389 discloses an additive-containing titanyloxyphthalocyanine which exhibits a maximal peak at 27.2 degrees of Bragg angle ($2\theta \pm 0.2°$) in an X-ray diffraction spectrum measured with Cu-K $\alpha$ radiation. The titanyloxyphthalocyanine pigments are also applied in the activation-treated form. The electrophotographic properties of the photoconductors which employ titanyloxyphthalocyanine pigments are further improved by modification of the crystal form of the pigment, such as by an acid pasting treatment or by an appropriate milling treatment.

Although the photosensitivity of the additive-containing titanyloxyphthalocyanine pigment is improved by the treatments as described above, deviations in the charge retention rate often occur. As a result, image defects, including background fogging, are commonly observed.

The cause of the deviations in the charge retention rate is not known. The Japanese Unexamined Laid Open Patent Application No. H03-54572 discloses a substance that is involved in the production of deviations in charge retention rates in metal-free phthalocyanine-containing photoconductors. However, the inter-molecular distance of titanyloxyphthalocyanine is different from that of metal-free phthalocyanine. Moreover, the titanium metal and oxygen in titanyloxyphthalocyanine cause effects which metal-free phthalocyanine does not exhibit. Therefore, the reasons for deviations in the charge retention rate of titanyloxyphthalocyanine pigments remains unknown.

OBJECTS AND SUMMARY OF THE INVENTION

In view of the foregoing, it is an object of the invention to provide a photoconductor that exhibits high sensitivity and a high charge retention rate.

It is another object of the present invention to provide a photoconductor in which deviations in the charge retention rate remain confined in a narrow range.

Briefly stated, a photoconductor for electrophotography includes a photoconductive layer that contains titanyloxyphthalocyanine as a charge generation agent. The concentration of $SO_4^{2-}$ with respect to the concentration of titanyloxyphthalocyanine is adjusted to be less than or equal to 500 ppm. The photoconductor may be of either a monolayer or a laminate construction. In the case of a laminate type photoconductor, the titanyloxyphthalocyanine is incorporated into the charge generation layer.

According to the present invention, a photoconductor for electrophotography comprises a conductive substrate, a photoconductive layer, the photoconductive layer including titanyloxyphthalocyanine, and a concentration of $SO_4^{2-}$ with respect to a concentration of the titanyloxyphthalocyanine in the photoconductive layer being not more than 500 ppm by weight.

According to another embodiment of the present invention, a method for manufacturing a photoconductor for electrophotography comprises the steps of producing a photoconductive material containing a titanyloxyphthalocyanine compound, adjusting an $SO_4^{2-}$ concentration in the photoconductive material with respect to a concentration of the titanyloxyphthalocyanine compound to be not more than 500 ppm by weight, and thereafter coating the photoconductive material onto a conductive substrate.

According to another embodiment of the present invention, a method for manufacturing a photoconductor for electrophotography comprising the steps of producing a photoconductive material containing a titanyloxyphthalocyanine compound, adjusting an $SO_4^{2-}$ concentration in the photoconductive material with respect to a concentration of the titanyloxyphthalocyanine compound to be not more than 500 ppm by weight, thereafter coating the photoconductive material onto a conductive substrate to form a charge generation layer, and providing a charge transport layer on the charge generation layer.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a cross-sectional view of a positive-charging monolayer type photoconductor.

DETAILED DESCRIPTION OF THE PREFERRED EMBODIMENT

Figure 1A:
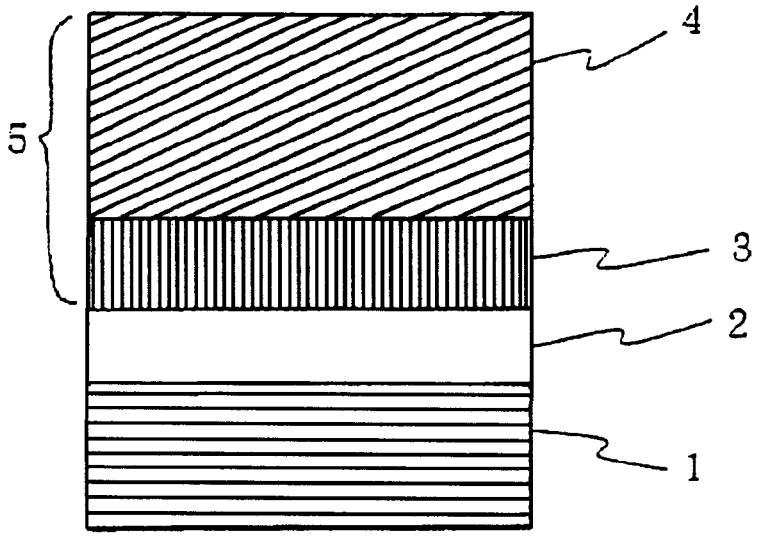
FIG. 1(*a*) is a cross-sectional view of a negative-charging function separation-type photoconductor.
Figure 1B:
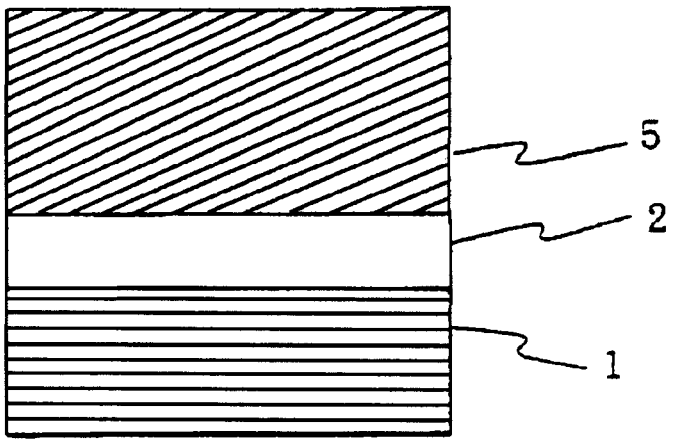

Photoconductors may be classified into negative-charging laminate-type photoconductors, positive-charging laminate-type photoconductors, and positive-charging monolayered photoconductors. Referring now to FIG. 1(*a*), a negative-charging function-separation type photoconductor includes a conductive substrate 1, an undercoating film 2 on the substrate 1, and a photoconductive film 5 on the undercoating film 2. The photoconductive film 5 includes a charge generation layer 3 for generating electric charges and a charge transport layer 4 for transporting the electric charges generated by generation layer 3.

Referring now to FIG. 1(*b*), a positive-charging monolayer type photoconductor includes a conductive substrate 1, an undercoating film 2 on the substrate 1 and a monolayer photoconductive film 5 on the undercoating film 2. The monolayer photoconductive film 5 exhibits the functions of charge generation and charge transport.

In the photoconductors shown in FIGS. 1(*a*) and 1(*b*), undercoating film 2 is optional. Furthermore, a protective film (not shown) may be formed on the outermost layer of the photoconductors of FIGS. 1(*a*) and 1(*b*).

Hereinafter, the photoconductor of the present invention will be described in more detail in terms of a negative-charging laminate-type of FIG. 1(*a*). It is to be understood that the photoconductor of the present invention is not limited to this type of photoconductor, but would also be suitable for use in a positive-charging laminate-type photoconductor or a positive-charging monolayer type photoconductor. The other materials and processes for manufacturing the photoconductor of the invention may be selected as required, using materials and procedures well-known to those in the art.

Conductive substrate 1 functions as an electrode of the photoconductor, and a means for supporting the constituent films and layers of the photoconductor. Conductive substrate 1 may be shaped as a cylindrical tube, plate or film. Metals such as aluminum, stainless steel and nickel may be used for conductive substrate 1. Glass and resins which are made electrically conductive may also be used for conductive substrate 1.

The materials used in making undercoating film 2 may include alcohol-soluble polyamide, alcohol-soluble aromatic polyamide, and thermosetting urethane resin. Preferable alcohol-soluble polyamides for use in undercoating film 2 include copolymerized compounds of nylon 6, nylon 8, nylon 12, nylon 66, nylon 610 and nylon 612, N-alkyl modified nylon, and N-alkoxyalkyl modified nylon. Typical copolymerized compounds described above include the copolymerized nylons of nylon 6, nylon 66, nylon 610, and nylon 612 (i.e., Amilan CM 8000, from Toray Industries, Inc.) and copolymerized nylon consisting mainly of nylon 12 (i.e., Daiamide T-171, from Daicel Hules Ltd.). Small-grained powders of inorganic compounds, such as $TiO_2$, alumina, calcium carbonate, and silica, may also be contained in undercoating film 2.

Charge generation layer 3 may be formed by coating onto conductive substrate 1 or undercoating film 2 particles of an organic photoconductive material mixed with a resin binder. Alternatively, charge generation layer 3 may be formed by coating onto conductive substrate 1 or undercoating film 2 a coating liquid containing a resin binder mixed with a solvent into which an organic photoconductive material is dispersed.

Charge generation layer 3 generates electric charges in response to received light. It is important for charge generation layer 3 to exhibit a high charge generation efficiency. It is also important for charge generation layer 3 to facilitate injecting generated charges into charge transport layer 4. It is further desirable for the charge generation layer 3 to have a charge-injection efficiency exhibiting a minimal electric field dependence.

Since charge transport layer 4 is formed on charge generation layer 3, the thickness of charge generation layer 3 is determined by the light absorption coefficient of the charge generation agent. The charge generation layer is preferably 5 $\mu$m or less in thickness, and more preferably 1 $\mu$m or less in thickness. Charge generation layer 3 mainly contains a charge generation agent, to which a charge transport agent may be added. The binder resin for the charge generation layer may include polymers, copolymers, halides and cyanoethyl compounds of polycarbonate, polyester, polyamide, polyurethane, epoxy, poly(vinyl butyral), phenoxy, silicone, polymethacrylate, vinyl chloride, ketal, vinyl acetate and appropriate combinations. From 10 to 500 weight parts, and preferably from 50 to 100 weight parts of a charge generation agent is used with respect to 100 weight parts of the binder resin described above.

The charge generation layer of the photoconductor according to the present invention contains titanyloxyphthalocyanine as the main charge generation agent thereof. Other charge generation agents, such as azo pigments, quinone pigments, indigo pigments, cyanine pigments, squalane and azulenium may also be included in charge generation layer 3.

In the present invention, the $SO_4^{2-}$ concentration in the titanyloxyphthalocyanine-containing layer is adjusted to be 500 weight ppm or less. When the $SO_4^{2-}$ concentration in the titanyloxyphthalocyanine-containing layer is 500 weight ppm or less, the dark current in the charge generation layer is reduced. As a result, the photoconductor of the present invention exhibits a high charge-retention rate and excellent reproducibility.

To produce a photoconductor according to the present invention having sufficient sensitivity, an $SO_4^{2-}$-containing titanyloxyphthalocyanine compound which exhibits a maximal peak at 9.6 degrees of Bragg angle (2 $\theta \pm 0.2°$) in an X-ray diffraction spectrum measured with Cu-K $\alpha$ radiation is preferable. An $SO_4^{2-}$-containing titanyloxyphthalocyanine compound which exhibits peaks at least at 9.6, 14.2, 14.7, 18.0 and 27.2 degrees of Bragg angle, among which the peak at 9.6 degrees of Bragg angle is maximal, is more preferable. An $SO_4^{2-}$ -containing titanyloxyphthalocyanine compound which exhibits a maximal peak at 27.2 degrees of Bragg angle is also preferable.

Charge transport layer 4 is a coating layer containing a resin binder into which a charge transport agent or charge transport agents selected from various hydrazone compounds, styryl compounds, amine compounds and their derivatives are dissolved. Charge transport layer 4 works as an insulator which retains electric charges of the photoconductor in the dark, and as a conductor which transports the electric charges injected from charge generation layer 3 in response to the received light.

The binder resin for charge transport layer 4 is selected from polymers and copolymers of, for example, polycarbonate, polyester, polystyrene and polymethacrylate, by considering the requirements for mechanical stability, chemical stability, electrical stability, adhesiveness and compatibility with the charge transport agent. From 20 to 500 weight parts, preferably from 30 to 300 weight parts of a charge transport agent is used with respect to 100 weight parts of a binder resin. The thickness of the charge transport layer is preferably from 3 to 50 $\mu$m for maintaining an effective surface potential, and more preferably, from 10 to 40 $\mu$m.

Conventional coating methods, such as dip-coating and spray-coating, may be used for coating the coating liquid for each layer or film.

Preparation of titanyloxyphthalocyanine (Method 1)

A mixture of 800 g of o-phthalodinitrile (from Tokyo Chemical Industry Co., Ltd.) and 1.8 L of quinoline was stirred in a reaction vessel. Then, 297 g of titanium tetrachloride was added drop by drop to the above described mixture stirred under a nitrogen atmosphere. The mixture with titanium tetrachloride added thereto was heated at 180° C. for 15 hr with stirring.

The reactant solution was cooled to 130° C. Then, the cooled reactant solution was filtered, and the filtered cake was washed with N-methyl-2-pyrrolidinone (from Kanto Kagaku Co., Ltd.). The washed wet cake was heated at 160° C. for 1 hr in N-methyl-2-pyrrolidinone and stirred. The wet cake and N-methyl-2-pyrrolidinone were cooled and filtered. The filtered cake was washed sequentially with N-methyl-2-pyrrolidinone, acetone, methanol and warm water.

The wet cake, thus obtained, was heated at 80° C. for 1 hr and stirred with dilute hydrochloric acid, consisting of 4 L of water and 360 ml of 36% hydrochloric acid. Then, the wet cake was cooled, filtered and washed with warm water. A titanyloxyphthalocyanine mixture was thus obtained.

Two hundred grams of the above described titanyloxyphthalocyanine mixture was added to 4 kg of 98% sulfuric acid. The sulfuric acid solution was cooled and stirred for 1 hr while maintaining the liquid temperature below −5° C. The sulfuric acid solution was then added to ice water, cooled, and stirred so that the liquid temperature did not exceed 10° C. The aqueous solution was then cooled and stirred for 1 hr. The resulting aqueous solution was filtered to obtain a wet cake.

A total of ten separate samples were prepared as described above. Each of these wet cake samples were washed from once to 5 times with either pure water or a mixed solvent, consisting of 1 part of methanol to 1 part of water. In this fashion, $SO_4^{2-}$-containing titanyloxyphthalocyanine specimens 1–10 were obtained. The $SO_4^{2-}$ concentrations in the titanyloxyphthalocyanine specimens were analyzed. The volume of the washing agent used for each filtering operation was 5 L. Table 1 lists the washing and filtering conditions, and the $SO_4^{2-}$ concentrations of the titanyloxyphthalocyanine specimens.

TABLE 1

| Specimens | Washing and filtering conditions | $SO_4^{2-}$ concentration ppm by weight) |
|---|---|---|
| 1 | Mixed solvent-5 times | 100 |
| 2 | Mixed solvent-4 times | 200 |
| 3 | Mixed solvent-3 times | 500 |
| 4 | Mixed solvent-2 times | 700 |
| 5 | Mixed solvent-once | 2500 |
| 6 | Pure water-5 times | 400 |
| 7 | Pure water-4 times | 900 |
| 8 | Pure water-3 times | 1500 |
| 9 | Pure water-2 times | 2000 |
| 10 | Pure water-once | 5000 |

Table 1 shows that the mixed solvent consisting of 1 part of methanol to 1 part of water is more effective than pure water in removing $SO_4^{2-}$ from the $SO_4^{2-}$-containing titanyloxyphthalocyanine specimens. Repeated washing and filtering operations further reduced the $SO_4^{2-}$ concentration.

These $SO_4^{2-}$-containing titanyloxyphthalocyanine specimens were mixed with a dilute hydrochloric acid solution, consisting of 10 L of water and 770 ml of 36% hydrochloric acid. The dilute HCl samples were then heated and stirred at 80° C. for 1 hr. The mixtures were cooled, filtered and washed with warm water. Each of the resulting wet cakes was mixed with 1.5 L of o-dichlorobenzene (from Kanto Kagaku Co., Ltd.) and milled at room temperature for 24 hr in a ball mill with 6.6 kg of zirconia balls (8 mm in diameter). The mixture was filtered and the filtered cake was dried to obtain the titanyloxyphthalocyanine specimens.

Embodiments 1–4 (E1–E4) & Comparative Examples 1, 2, 5–8 (C1, C2, C5–C8)

Coating liquid for an undercoating film was prepared by mixing 70 weight parts of polyamide resin (Amilan CM 8000, from Toray Industries, Inc.) and 930 weight parts of methanol. The coating liquid was coated on an aluminum substrate by dip-coating and dried. An undercoating film of 0.5 $\mu$m in dry film thickness was thus obtained.

Figure 2:
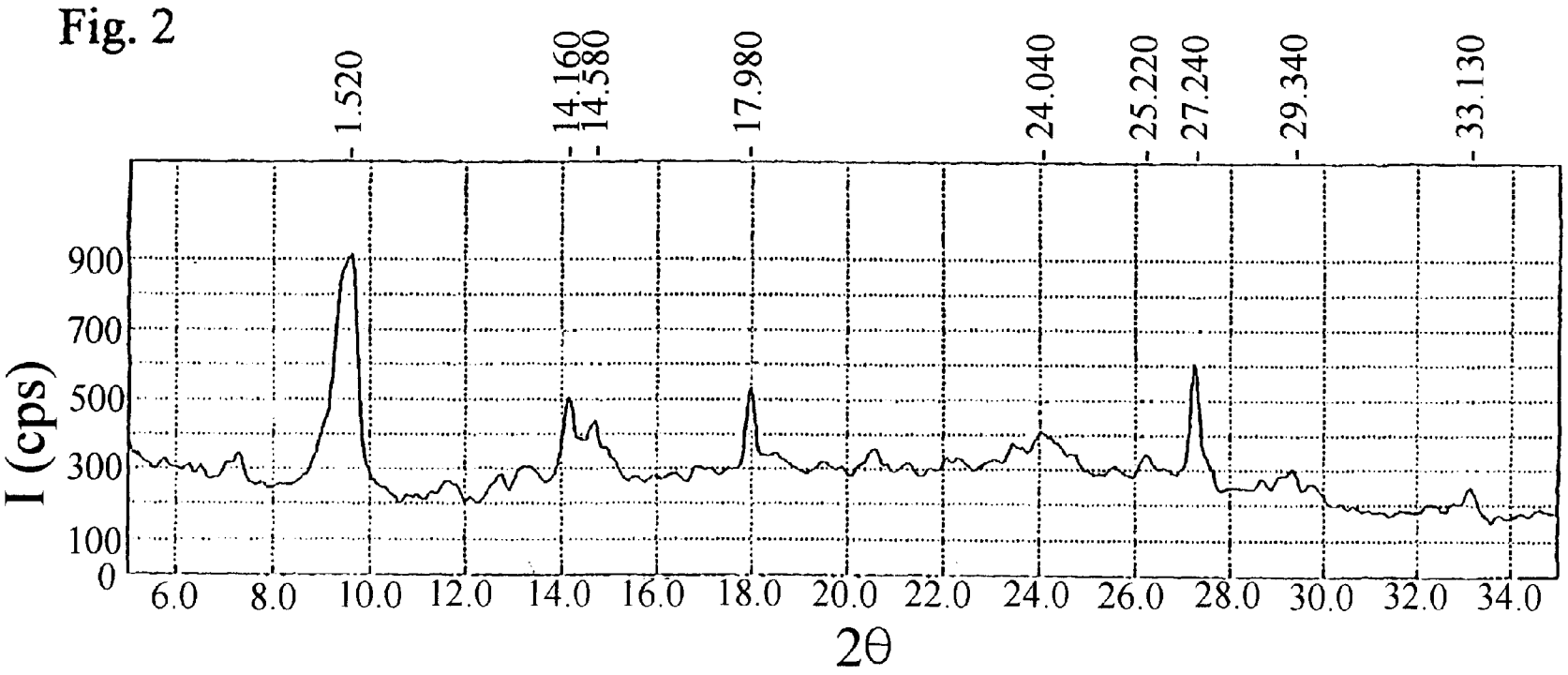
FIG. 2 is a an X-ray diffraction spectrum of an $SO_4^{2-}$-containing titanyloxyphthalocyanine specimen.

Ten kinds of coating liquid for the charge generation layer were prepared by dispersing 10 weight parts of each titanyloxyphthalocyanine specimen prepared by Titanyloxyphthalocyanine Preparation Method 1 and 10 weight parts of vinyl chloride resin (MR-110, from Nippon Zeon Co., Ltd.) into 1000 weight parts of dichloromethane. A portion of each coating liquid was evaporated to dryness, and the X-ray diffraction spectrum of the dried residue was measured with an X-ray diffractometer (MXP18VA, from Mac Science Inc.) using Cu-K $\alpha$ radiation. The X-ray diffraction spectra of all the specimens exhibited a maximal peak at 9.6 degrees of Bragg angle. FIG. 2 is an example of one of the X-ray diffraction spectra obtained from these specimens. The coating liquid for the charge generation layer was coated onto the undercoating film by dip-coating, producing a charge generation layer of 0.2 $\mu$m in dry thickness.

Coating liquid for the charge transport layer was prepared by mixing 100 weight parts of 4-(diphenylamino) benzaldehydephenyl (2-thienyl methyl) hydrazone (synthesized in Fuji Electric Co., Ltd.), 300 weight parts of polycarbonate resin (Panlite K-1, from Teijin Ltd.), 800 weight parts of dichloromethane, and 1 weight part of silane coupling agent (KP-340, from Shin-Etsu Chemical Co., Ltd.). The coating liquid for the charge transport layer was coated onto the charge generation layer by dip-coating and dried. A charge transport layer of 20 $\mu$m in dry thickness was formed.

Preparation of titanyloxyphthalocyanine (Method 2)

Titanyloxyphthalocyanine was also prepared by the method described in European Patent Application No. EP 0

405 420 A1 (corresponding to Japanese Patent Application KOKAI No. H03-035245, page 14, lines 33–38), the entirety of which is hereby incorporated by reference. The titanyloxyphthalocyanine obtained by this method was dissolved in concentrated sulfuric acid as described in Preparation Method 1, above. The washing conditions for the filtration step after the step of dissolving titanyloxyphthalocyanine into sulfuric acid were the same as in Titanyloxyphthalocyanine Preparation Method 1. Then, the $SO_4^{2-}$ concentrations of the titanyloxyphthalocyanine specimens produced by Titanyloxyphthalocyanine Preparation Method 2 were measured. Table 2 lists the results.

TABLE 2

| Specimens | Washing and filtering conditions | $SO_4^{2-}$ concentration ppm by weight) |
|---|---|---|
| 11 | Mixed solvent-5 times | 200 |
| 12 | Mixed solvent-4 times | 300 |
| 13 | Mixed solvent-3 times | 500 |
| 14 | Mixed solvent-2 times | 800 |
| 15 | Mixed solvent-once | 3000 |
| 16 | Pure water-5 times | 500 |
| 17 | Pure water-4 times | 1000 |
| 18 | Pure water-3 times | 1600 |
| 19 | Pure water-2 times | 2100 |
| 20 | Pure water-once | 5500 |

As was the case in Table 1, Table 2 shows that the mixed solvent consisting of 1 part of methanol to 1 part of water is more effective than pure water in removing $SO_4^{2-}$ from the $SO_4^{2-}$-containing titanyloxyphthalocyanine specimens. Repeated washing and filtering operations further reduced the $SO_4^{2-}$ concentration. The values of the $SO_4^{2-}$ concentrations in the $SO_4^{2-}$-containing titanyloxyphthalocyanine specimens prepared by Titanyloxyphthalocyanine Preparation Method 2 were in many cases very similar to those obtained by Titanyloxyphthalocyanine Preparation Method 1. It is considered that other methods of adjusting the $SO_4^{2-}$ concentrations in the $SO_4^{2-}$-containing titanyloxyphthalocyanine specimens well-known to those in the art would also be encompassed by this invention.

Embodiments 5–8 (E5–E8) & Comparative Examples 9–14 (C9–C14)

The photoconductors of Embodiments 5 through 8 (F5–E8) and the Comparative Examples 9 through 14 (C9–C14) were fabricated in the same manner as the photoconductors of Embodiments 1 through 4 and the comparative examples 1, 2, 5–8, except that the titanyloxyphthalocyanine specimens 11 through 20 were used in the Embodiments 5 through 8 and the Comparative Examples 9 through 14. The X-ray diffraction spectra of the specimens 11 through 20 had a maximal peak at 27.2 degrees of Bragg angle.

The electrical properties of the photoconductors of the Embodiments 1 through 8 and the Comparative Examples 1, 2, 5–14 were measured in an electrostatic recording paper testing apparatus (EPA-8200, from Kawaguchi Electric Works Co., Ltd.) at 20° C. and 50% RH. Results are listed in Table 3, together with the $SO_4^{2-}$ concentrations. In Table 3, the initial charge potential Vo is a potential measured after charging the photoconductor surface to be negative by corona discharge at −5 kV for 10 sec in the dark. The charge retention rate Vk5 of the photoconductor surface is a ratio of the initial charge potential Vo to the surface charge potential 5 sec after the end of the corona discharge. The exposure light intensity E100 is the intensity of a laser beam of 780 nm, under the irradiation of which the surface charge potential of the photoconductor decays down to −100 V. The potential $V_L$ is a potential of the irradiated portion of each photoconductor irradiated by a light of 3 $\mu$W.

TABLE 3

| Photo-conductors | Spec-i-mens | $SO_4^{2-}$ concentration (ppm by weight) | $V_0$ (V) | Vk5 (%) | $V_L$ (V) | E100 ($\mu$J/cm$^2$) |
|---|---|---|---|---|---|---|
| E1 | 1 | 100 | −620 | 96 | −20 | 0.35 |
| E2 | 2 | 200 | −615 | 96 | −24 | 0.34 |
| E3 | 3 | 500 | −591 | 95 | −29 | 0.36 |
| E4 | 6 | 400 | −602 | 95 | −27 | 0.34 |
| E5 | 11 | 200 | −623 | 96 | −23 | 0.33 |
| E6 | 12 | 300 | −607 | 95 | −17 | 0.35 |
| E7 | 13 | 500 | −594 | 95 | −22 | 0.34 |
| E8 | 16 | 500 | −603 | 95 | −26 | 0.35 |
| C1 | 4 | 700 | −485 | 92 | −26 | 0.35 |
| C2 | 5 | 2500 | −430 | 88 | −21 | 0.37 |
| C5 | 7 | 900 | −467 | 92 | −24 | 0.35 |
| C6 | 8 | 1500 | −450 | 88 | −25 | 0.36 |
| C7 | 9 | 2000 | −435 | 86 | −28 | 0.37 |
| C8 | 10 | 5000 | −400 | 77 | −24 | 0.40 |
| C9 | 14 | 900 | −477 | 91 | −21 | 0.36 |
| C10 | 15 | 3000 | −421 | 86 | −24 | 0.37 |
| C11 | 17 | 1000 | −459 | 91 | −28 | 0.36 |
| C12 | 18 | 1600 | −455 | 88 | −24 | 0.37 |
| C13 | 19 | 2100 | −426 | 85 | −23 | 0.39 |
| C14 | 20 | 5500 | −422 | 76 | −22 | 0.38 |

Table 3 shows that the Embodiments E1–E8 all have $SO_4^{2-}$ concentrations at or below 500 ppm. Comparative Examples C1–C14 all have $SO_4^{2-}$ concentrations above 500 ppm. The $V_0$ values for the Embodiments 1–8 are all less than −590 V, while those of the Comparative Examples are all between −485 V and −400 V. More importantly, when the $SO_4^{2-}$ concentration is 500 weight parts or less, the charge retention rate is 95% or higher. As noted above, a higher charge retention rate is preferable.

In the preparations 1 and 2 of titanyloxyphthalocyanine, the $SO_4^{2-}$ concentration is adjusted to be 500 weight parts or less by washing 3 times with the mixed solvent consisting of 1 part of methanol and 1 part of water or by washing 5 times with pure water in filtering the sulfuric acid solution of titanyloxyphthalocyanine. The $SO_4^{2-}$ concentration may also be adjusted by the other methods.

By adjusting the $SO_4^{2-}$ concentration in titanyloxyphthalocyanine to be 500 weight parts or less, a photoconductor which exhibits an unexpectedly high charge retention rate and low initial charge potential is manufactured with excellent reproducibility. The photoconductor of the invention facilitates obtaining clear and high-quality images free from background fogging.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography, comprising:

a conductive substrate;

a photoconductive layer;

said photoconductive layer including titanyloxyphthalocyanine; and a concentration of $SO_4^{2-}$ with respect to a concentration of said titanyloxyphthalocyanine in said photoconductive layer being from 100 ppm by weight to not more than 500 ppm by weight.

2. A photoconductor for electrophotography according to claim 1, wherein said titanyloxyphthalocyanine exhibits a maximal peak at 9.6 degrees of Bragg angle (2 θ±0.2°) in an X-ray diffraction spectrum measured with Cu-K α radiation.

3. A photoconductor for electrophotography according to claim 1, wherein said titanyloxyphthalocyanine exhibits peaks at 9.6, 14.2, 14.7, 18.0, and 27.2 degrees of Bragg angle in an X-ray diffraction spectrum measured with Cu-K α radiation.

4. A photoconductor for electrophotography according to claim 3, wherein said peak at 9.6 degrees of Bragg angle is maximal.

5. A photoconductor for electrophotography according to claim 1, wherein said titanyloxyphthalocyanine exhibits a maximal peak at 27.2 degrees of Bragg angle in an X-ray diffraction spectrum measured with Cu-K α radiation.

6. A photoconductor for electrophotography according to claim 1, wherein:

said photoconductive layer includes a charge generation layer and a charge transport layer; and said charge generation layer contains said titanyloxyphthalocyanine.

7. A photoconductor for electrophotography according to claim 1, wherein:

said charge generation layer further includes a binder resin; and said titanyloxyphthalocyanine is present at an amount between 10 to 500 weight parts with respect to 100 weight parts of said binder resin.

8. A method for manufacturing a photoconductor for electrophotography, comprising the steps of:

producing a photoconductive material containing a titanyloxyphthalocyanine compound;

adjusting an $SO_4^{2-}$ concentration in said photoconductive material with respect to a concentration of said titanyloxyphthalocyanine compound to be from 100 ppm by weight to not more than 500 ppm by weight; and thereafter coating said photoconductive material onto a conductive substrate.

9. A method according to claim 8, further comprising coating an undercoating layer onto said conductive substrate before said step of coating said photoconductive material onto said conductive substrate.

10. A method according to claim 8, wherein said step of adjusting includes removing $SO_4^{2-}$ by washing.

11. A method for manufacturing a photoconductor for electrophotography, comprising the steps of:

producing a photoconductive material containing a titanyloxyphthalocyanine compound;

adjusting an $SO_4^{2-}$ concentration in said photoconductive material with respect to a concentration of said titanyloxyphthalocyanine compound to be from 100 ppm by weight to not more than 500 ppm by weight;

thereafter coating said photoconductive material onto a conductive substrate to form a charge generation layer; and forming a charge transport layer on said charge generation layer.

12. A method according to claim 11, further comprising coating an undercoating layer onto said conductive substrate before said step of coating said photoconductive material onto said conductive substrate to form said charge generation layer.

13. A method according to claim 11, wherein said step of adjusting includes removing $SO_4^{2-}$ by washing.

* * * * *